United States Patent [19]

Sado

[11] 4,011,700

[45] Mar. 15, 1977

[54] ADJUSTABLE-HEIGHT POST ASSEMBLY FOR READY INSTALLATION ON A WINDOW FRAME OR THE LIKE

[75] Inventor: Yukio Sado, Asahi, Japan

[73] Assignee: Yoshida Kogyo Kabushiki Kaisha, Toyko, Japan

[22] Filed: Nov. 20, 1975

[21] Appl. No.: 633,957

[30] Foreign Application Priority Data

Nov. 27, 1974 Japan ..... 49-144528

[52] U.S. Cl. ..... 52/235; 52/721; 403/104

[51] Int. Cl.[2] ..... E04H 1/00

[58] Field of Search ..... 52/235, 758 N, 703, 52/710, 706, 738, 721, 122, 126, 487; 211/175, 107; 248/245, 295; 403/157, 104, 257, 83

[56] References Cited

UNITED STATES PATENTS

| | | | |
|---|---|---|---|
| 3,489,291 | 1/1970 | Frazier | 248/245 X |
| 3,561,182 | 2/1971 | Madl, Jr. | 52/665 X |

*Primary Examiner*—Ernest R. Purser
*Assistant Examiner*—Carl D. Friedman
*Attorney, Agent, or Firm*—Hill, Gross, Simpson, Van Santen, Steadman, Chiara & Simpson

[57] ABSTRACT

A post of uniform cross sectional shape for installation uprightly on the outside of a balustraded window or the like for use as one of the supports of the balustrade. The post includes a pair of opposite side walls each having an undercut groove formed lengthwise thereon. A pair of brackets of identical construction are provided separately, each comprising a mounting plate at one end and a pair of clamping jaws at the other end for engaging the post therebetween. The mounting plates of the brackets can be screwed to the window frame, and the post engaged between the clamping jaws of each bracket is connected thereto by a bolt inserted into and through a hole in each jaw and secured by a nut received in one of the undercut grooves of the post.

3 Claims, 3 Drawing Figures

FIG. 1
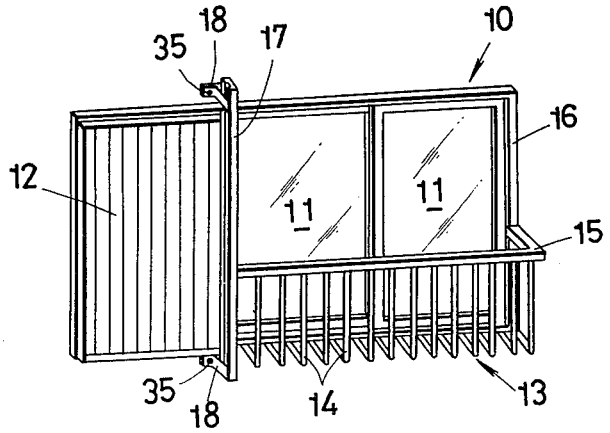
FIG. 2
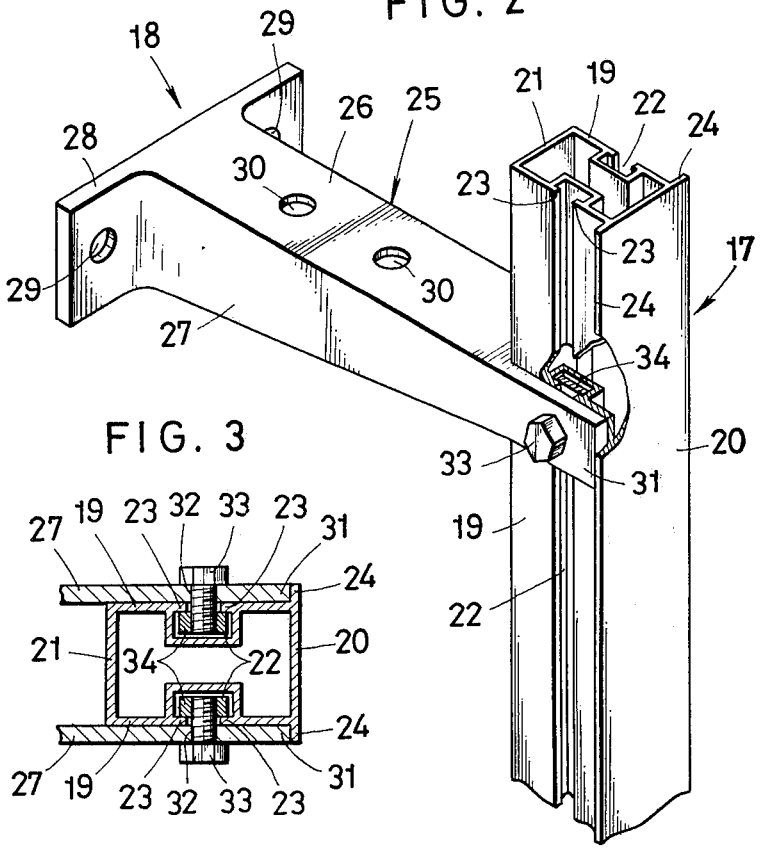
FIG. 3

ADJUSTABLE-HEIGHT POST ASSEMBLY FOR READY INSTALLATION ON A WINDOW FRAME OR THE LIKE

BACKGROUND OF THE INVENTION

1. Field of the Invention

This invention relates to an adjustable-height post assembly comprising a post and means for mounting same, for example, on the outside of a balustraded window. The post according to the invention is best adaptable for use as one of the upright supports of the balustrade when, for example, the window is furnished with horizontally moving outside shutters so that only one of the side jambs of the window frame can be used as the upright balustrade support.

2. Prior Art

The post of the above described character has heretofore been installed in a desired position on a building by means of brackets, with each bracket screwed at one end to the post. The windows or the like to which the post is to be bracketed, however, are often manufactured in accordance with different dimensional specifications by different manufacturers. Tne necessary screw holes in the post may therefore have to be formed in different positions thereon to suit the post to the exact vertical dimension of a particular window or the like, so that the installation of the conventional post by means of the conventional brackets has often involved a highly troublesome and time-consuming procedure.

SUMMARY OF THE INVENTION

It is an object of this invention to provide an adjustable-height post assembly comprising a post and a pair of brackets so constructed in relation to each other that the post can be readily installed on or over windows or the like of various vertical dimensions without need for machining screw holes in or otherwise modifying the existing parts of the post or of the brackets.

Briefly, the invention provides the combination of a post of uniform cross sectional shape throughout its length, and a pair of brackets of identical construction for installation of the post in a desired position. The post includes a pair of oppositely located side walls each having an undercut groove thereon. Each bracket includes a pair of spaced clamping jaws at one end for engaging the post therebetween in direct contact with the respective grooved side walls of the post. Each of the clamping jaws has a hole for insertion of a bolt therethrough into the undercut groove on one of the side walls of the post, with the bolt being secured by a nut accommodated in the undercut groove to fasten the post to each bracket. The bracket can be screwed or otherwise fastened to a desired stationary surface which is either vertical or horizontal.

The above and other objects, features and advantages of this invention and the manner of attaining them will become more apparent and the invention itself will best be understood by reference to the following description of a preferred embodiment, taken in connection with the accompanying drawings in which like reference characters refer to like parts throughout.

BRIEF DESCRIPTION OF THE DRAWINGS

FIG. 1 is a perspective view explanatory of one adaptation of this invention, in which the adjustable-height post assembly according to the invention is shown installed on a balustraded sash window complete with a shutter box, to illustrate the manner of use of the post as one of the upright supports of the balustrade;

FIG. 2 is an enlarged partial perspective view, partly broken away, showing in greater detail the post of FIG. 1 as connected to one of the brackets supporting same; and FIG. 3 is an enlarged partial horizontal cross-sectional view explanatory of the way in which the post of FIG. 1 is connected to one of the brackets.

DESCRIPTION OF THE PREFERRED EMBODIMENT

In FIG. 1 of the accompanying drawings the invention is shown adapted for use on or in conjunction with a window comprising a frame 10 and a pair of over-lapping sashes 11 mounted within the window frame for relative horizontal sliding or rolling movement. The window is further equipped with a shutter box 12 mounted next to and on one side of the window frame 10 for receiving horizontally moving outside shutters in their open position, and with a balustrade 13 mounted on the outside of the window.

The balustrade 13 comprises a row of balusters 14 topped by a rail 15. This rail has one end connected to the side jamb 16 of the window frame 10 remote from the shutter box 12, and the other end being connected to an upstanding post 17 extending along the entrance end or side of the shutter box. This invention is specifically directed to the construction of this post 17 and of a pair of brackets 18 for installation of the post in position over the window regardless of its vertical dimension.

With reference now to FIGS. 2 and 3, the post 17 is in the form of a hollow bar of uniform cross sectional shape throughout its length, which typically is formed by extrusion of suitable metal. The post 17 is substantially rectangular in cross-sectional shape, comprising a pair of oppositely located side walls 19 and front and rear walls 20 and 21. Each side wall 19 has an undercut groove 22 formed longitudinally thereon. By the term "undercut groove" is meant that the groove has a pair of opposed rims 23 extending along its open end. The front wall 20 of the post 17 has its lateral edges projecting beyond the respective side walls 19 to provide a pair of marginal flanges or rims 24.

The pair of brackets 18 for use with the post 17 are of exactly identical construction. Each bracket has a stem portion 25 of inverted-U-shaped cross-section, comprising a top wall 26 and a pair of side walls 27. The stem portion 25 terminates at its rear end in a mounting plate 28 having holes 29 formed therein for insertion of screws or like fasteners therethrough when the bracket is to be fastened to a vertical surface of a building. The top wall 26 of the bracket also has a pair of holes 30 for insertion of screws or like fasteners therethrough when the bracket is to be affixed to the underside of a projection, if any, above the window or to a like horizontal surface.

At its front end each bracket 18 has a pair of parallel spaced clamping jaws 31 adapted to engage the post 17 therebetween in direct contact with its side walls 19. The pair of clamping jaws 31 are formed, in essence, by the forward extensions of the side walls 27 of the stem portion 25, and each jaw has a hole 32 for insertion of a bolt 33 therethrough into the undercut groove 22 on one of the side walls 19. Each bolt 33 is shown to be a hexagon-headed machine bolt which is threaded throughout the length of its shank. This bolt is to be secured by a nut 34 received in the undercut groove 32 so as to engage the pair of opposed rims 23.

For installation of the post 17 in position on the window of FIG. 1, for use as one of the upright supports of the balustrade 13, the pair of brackets 18 may first be tentatively mounted at or adjacent the opposite ends of the post by turning the pair of bolts 33 into the respective nuts 34 received in the undercut grooves 22. Then, with the bolts 33 on the lower one of the brackets 18 loosened, the lower bracket is slid relatively along the post 17 to an exact required position thereon for affixation to the sill of the window frame 10 or to the neighboring finished area of the building. The bolts 33 on this lower bracket are then re-tightened, and the bracket is affixed to the vertical surface of the sill or of the neighboring area as by screws 35 driven therein through the holes 29 in its mounting plate 28.

The bolts 33 on the upper bracket 18 are subsequently loosened, and the upper bracket is slid along the post 17 to an exact required position thereon for affixation to the header of the window frame 10 or to the neighboring finished area of the building. The bolts 33 on the upper bracket are then re-tightened, and screws 35 or like fasteners are similarly driven through the holes 29 in its mounting plate 28 to secure the bracket to the vertical surface of the header or of the neighboring area. The post 17 is now installed in position as shown in FIG. 1.

If the window of FIG. 1 has overhanging structure thereabove, and if the structure has a suitable horizontal surface directed downwardly, then, alternatively the upper bracket 18 may be slid up along the post 17 into contact with such horizontal surface and affixed thereto as by screws driven through the holes 30 in the top wall 26 of the bracket. The affixation of the upper bracket to the overhanging structure or the like is preferable because the bracket can be more easily mounted and because the post can be more securely supported since the holes 30 in the top wall of the bracket are located closer to the pair of clamping jaws 31 at its front end.

Although an illustrative embodiment of this invention has been described in detail herein with reference to the accompanying drawings, it is to be understood that the invention is not limited to the exact details disclosed and that various changes and modifications may be effected therein by those skilled in the art without departing from the spirit or scope of the invention as expressed in the following claims.

What is claimed is:

1. An assembly comprising in combination:

a. a post of uniform cross-sectional shape throughout its length, said post including a pair of oppositely facing side walls, therebeing a pair of oppositely opening undercut grooves extending longitudinally along the length of said side walls respectively;

b. a pair of brackets spaced along the length of said post, each bracket comprising (1) means for mounting the same on a desired stationary surface, and (2) a pair of integral spaced clamping jaws at one end receiving said post and said undercut grooves therebetween in direct contact with said respective oppositely facing side walls of said post;

c. two pairs of nuts respectively disposed in said oppositely facing grooves; and d. two pairs of bolts respectively extending through holes in said clamping jaws into said nuts in said grooves.

2. An assembly according to claim 1 in which said post has a pair of flanges overlying the ends of said clamping jaws.

3. An assembly according to claim 1, in which said mounting means of each said bracket comprises an apertured mounting plate disposed at its end opposite to said one end thereof and adapted to be affixed to a surface parallel to the length of said post, each said bracket being further apertured flush with an edge of said mounting plate for reception of fasteners therethrough so as to enable the bracket to be affixed to a surface extending transversely to the length of said post.

* * * * *